United States Patent [19]

Beattie et al.

[11] 4,430,003

[45] Feb. 7, 1984

[54] APPARATUS FOR SPRAYING LIQUIDS SUCH AS RESINS AND WAXES ON SURFACES OF PARTICLES

[75] Inventors: Norman W. Beattie, Surrey; Donald W. Nyberg, North Vancouver, both of Canada

[73] Assignee: Hawker Siddeley Canada, Inc., Vancouver, Canada

[21] Appl. No.: 207,964

[22] Filed: Nov. 18, 1980

[51] Int. Cl.[3] ..... B01F 9/06; B01F 15/02

[52] U.S. Cl. ..... 366/173; 366/180; 366/228; 366/233; 118/303; 118/418; 239/224

[58] Field of Search ..... 366/167, 170, 173, 174, 366/175, 187, 220, 225, 228, 229, 233, 180; 118/303, 418; 427/212; 239/223, 224

[56] References Cited

U.S. PATENT DOCUMENTS

| | | | |
|---|---|---|---|
| 2,986,338 | 5/1961 | Foster | 239/224 X |
| 3,101,040 | 8/1963 | Lanz . | |
| 3,974,307 | 8/1976 | Bowen | 118/418 X |
| 4,193,700 | 3/1980 | Wirz | 366/156 |
| 4,237,814 | 12/1980 | Ormós et al. | 118/303 X |

*Primary Examiner*—Stephen Marcus
*Assistant Examiner*—Joseph M. Pitko
*Attorney, Agent, or Firm*—Roy E. Mattern, Jr.

[57] ABSTRACT

To uniformly and economically disperse liquids, via sprays of droplets, on surfaces of particles, a method moving the particles involves their rotary lifting, followed by their free falling, with a spray of droplets originating from a central area of the overall motion path of the particles. In a preferred embodiment of the blending apparatus, a hollow drum is rotated about a near horizontal axis. Inside the drum, commencing at each end are cantilevered non-rotating shafts, each positioning one or more powered slightly conical disc selectively tiltable to ultimately disperse respective sprays of droplets from a central area. This central area is defined by particles being lifted while centrifugally, for example, as the drum of eight feet in diameter is rotated at twenty seven revolutions per minute held to the interior of the drum and then at a zenith locale the gravitational force becomes effective enough so the particles drop in an arcuate cascade path back to the interior surface of the drum to start another cycle. The cycles are predetermined to continue until the particles acquire the selective quantity of dispersed droplets on all of their surfaces. Then the particles leave the interior of the rotating hollow drum opposite the end of their entry into the drum. This method and apparatus is particularly useful in treating with liquid resin binders, and/or waxd emulsions, thin wood wafers, wood flakes, wood shavings, sawdust and other particles of like respective sizes, which often are subsequently collectively formed and pressed into products, such as wood wafer boards.

35 Claims, 18 Drawing Figures

APPARATUS FOR SPRAYING LIQUIDS SUCH AS RESINS AND WAXES ON SURFACES OF PARTICLES

CROSS REFERENCE

The application Ser. No. 06/208,307, filed Nov. 19, 1980 and this application Ser. No. 06/207,964, filed Nov. 18, 1980 include information common to both.

BACKGROUND OF THE INVENTION

Throughout industry there is often the requirement to efficiently and economically disperse liquids on the surfaces of particles which should not undergo mechanical damage or abrasion. Moreover, many of these particles are collectively crowded together to form a composite product. The integral strength success of the composite product, where, for example, the liquids are binders, is based on the uniform or near uniform dispersement of the liquid throughout all the surface areas of the particles.

These factors are especially true when wood products are being manufactured. However, present methods and available apparatus do not completely fulfill all of the currently desired economic, quality and efficiency objectives.

For example, in respect to the wood wafer board industry dispersement of resin binders is undertaken in blenders, wherein finely pulverized dry resin is applied to wood wafers via tumbling within an inclined rotating drum. The dry resin, so pulverized, is obtained at a higher cost than liquid resins. In the particle board industry wood chips are sprayed with liquid resins while the wood chips undergo intense agitation. The liquid resin is sprayed into the turbulent mass of wood chips via air atomization or via fluid pressure nozzles. These wood chip blenders have nozzles which produce droplets in an unwanted wide dispersion of droplet sizes. Their air driven atomization sprays tend to carry the finest droplets of resin out in air venting streams, thus creating a nuisance while wasting resin. Moreover, in these wood chip blenders, the intense agitation produces heat and creates more fine material from the particles, that in turn, tends to absorb a disproportionate fraction of the consumed resin. In addition, resin-particle agglomerates tend to build up on the walls and paddles of these blenders requiring frequent costly cleaning maintenance.

T. M. Maloney in 1977 in a Miller-Freeman publication on pages 438 through 457 in discussing modern particleboard and dry process fiberboard, said laboratory experimentation has shown that industrial blenders do not perform near optimum conditions. Thus important developments can yet be made in this critical production step.

In respect to information presented in U.S. patents, W. Wirz in his U.S. Pat. No. 4,193,700 of Mar. 18, 1980 disclosed a short length drum with internal vanes or lifters rotated to yield an intermittent cascade of particles, while a spray nozzle dispersed a binder in an axial direction, from the feed end of the drum into the particle cascade. Also K. Engels in his U.S. Pat. No. 4,188,130 of Feb. 12, 1980 illustrated and described a drum with internal lifters to rotary lift particles for their subsequent cascading, while at the feed end of the drum, nozzles axially sprayed liquid resin toward the particles. Although Messrs. Wirz and Engels' apparatus comparatively gently handled the particles, the reliance on axially directed sprays required a high droplet concentration of liquid resin to achieve a reasonable output rate of treated particles. Such high concentration of resin droplets tends to yield a wide range in droplet size and reduces the opportunity for uniform coverage of the particles. Moreover, because one third to two thirds of their interior drum surfaces and lifters are also exposed to the spray of resin, there is the wasteful accumulation of resin on these exposed interior surfaces, also incurring cleaning maintenance costs.

Improved dispersement of liquid resins is also needed in the emerging structural board manufacturing processes, wherein carefully sliced wood wafers and flakes are used. To attain maximum panel strengths of these structural boards the sliced wood wafers and flakes should remain undamaged in blending operations and thereafter they should be aligned, as described by H. D. Turner in an article entitled "Structural Flakeboard Stiffness—Relation to Deflection Criteria and Economic Performance," as published in *Forest Products Journal* Volume 27, Number 12, December 1977.

In respect to all such related uses of resins, the distribution of the resins must be very efficient. Resin, at five percent of the dry wood weight, has a resin cost which is about one half of the wood cost. Usually the resin cost is the second largest cost element in wood board manufacturing.

Therefore, gentle handling of flakes and maximum efficiency of the resin distribution with minimum losses of resin are both important objectives in operating wood board processes, and especially in operating structural board processes wherein the wood wafers and wood flakes are aligned.

SUMMARY OF INVENTION

A new blending method and new blending apparatus are provided to more efficiently utilize liquids such as resin binders and wax emulsions, particularly in the wood products industry, by creating controllable sprays of droplets having a high proportion of uniform sized droplets leaving the edges of spinning discs. The particles are moved via a gentle action and in reference to wood wafers or woodflakes, there is minimal damage or change to these particles. There are no high speed agitation forces or high pressure agitation forces involved. Moreover, blender maintenance is very minimal in respect to misdirected sprays of liquids and the accumulation of fines, both of which would otherwise cause plugging or jamming of a blender. This is true for the spray is essentially always intercepted by the particles, which shield the interior walls of the blender. By using the new blending method and apparatus, it is estimated the liquid savings, i.e. resin binder savings, etc., will range from three thousand to five thousand dollars a day, at 1980 price levels, during the operation of a typical three hundred ton capacity plant, i.e. a waferboard mill In respect to the method, the uniform and economical dispersement of the liquids, via sprays of droplets, on surfaces of particles is undertaken by moving the particles via rotary lifting, followed by their free falling, with a spray of droplets originating from a central area of the overall motion path of the particles.

In a preferred embodiment of the blending apparatus, a hollow drum of eight feet in diameter is rotated about a near horizontal axis for example, at twenty seven revolutions per minute. Inside the drum, commencing at each end are cantilevered nonrotating shafts, each positioning one or more powered slightly conical discs selectively tiltable to ultimately disperse respective sprays of droplets from a central area. This central area is determined or defined by the particles being lifted, while centrifugally held to the interior of the drum and then at the zenith locale near the top of the drum interior, the gravitational force becomes effective enough so the particles drop in an arcuate cascade path back down to the interior surface of the drum to start another cycle. These cycles of lifting and cascading are predetermined in number to continue until the particles acquire the selective and sufficient quantity of dispersed droplets on all their surfaces. Then the treated droplets leave the interior of the rotating hollow drum at the exit end, opposite the end of their entry into the drum. This method and apparatus is particularly useful in treating, with liquid binders and/or wax emulsions, thin wood wafers, wood flakes, wood shavings, sawdust, and other particles of like respective sizes, which often are subsequently collectively formed and pressed into products such as wood wafer boards and structural boards.

DESCRIPTION OF DRAWINGS

A preferred embodiment and other embodiments of the blending apparatus are illustrated in the drawings supplemented by illustrative manufacturing facility schematic flow charts, and graphs concerning the working range of droplet size and travel, wherein.

DESCRIPTION OFTHE INVENTION

One Environment For the Blending Method and Blender

Figure 1:
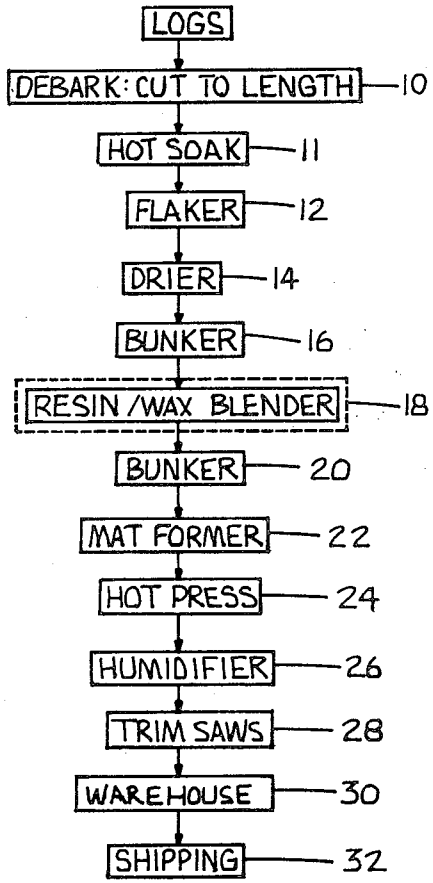
FIG. 1 is a schematic flow chart of a composite wood product manufacturing facility indicating where the blending apparatus and method are utilized with respect to the order of the overall apparatus and method.

The invention relates to a method and apparatus for applying a liquid, such as resin binder or wax, to particles, such as wood wafers of the type used in making waferboard. A preferred embodiment is described in reference to its utilization in a manufacturing process wherein wood particles are formed and pressed into wood products. In FIG. 1 the overall method steps and related apparatus of such a manufacturing process are illustrated in chart form. Logs are debarked and cut to length 10; hot soaked 11; flakes or other particles are made 12; they are dried 14; and as necessary the dried flakes are stored in a bunker 16, for subsequent processing. These inventions, i.e. both a blending method and a blender 18, are used in the next step of the overall process, wherein the particles are efficiently, economically, and uniformly treated in the blender being sprayed with droplets of resin binder and/or wax emulsions. The treated particles are, if necessary, stored in a bunker 20; then formed 22 in a mat; hot pressed 24, adjusted for moisture content in a humidifier 26; trimmed by saws 28; stored, as necessary, in a warehouse 30; and shipped 32 upon an order of a customer.

Disc Spraying Theory, Creation and Dispersion of Droplets, Their Sizes and Travel In the practice of this method and the arrangement and operation of the apparatus, the creation of the liquid droplets in all respects, and especially in reference to their sizes and travel, is very important. Also the movement of the particles to receive the dispersed droplets is likewise very important. This is true because a uniform spaced distribution of small droplets is wanted throughout all the surfaces of the particles. Droplets that are too large upon reaching the particles are wasteful of the liquids. Droplets that are too small fail to travel far enough to reach the particles and coalesce enroute.

In reference to a disc spraying theory, the production of sprays and mists by means of spinning discs, is believed to have been first investigated experimentally and theoretically by Messrs. Walton and Prewett and later in more detail by Mr. Drummond. Their earlier experiments may have pertained to spinning discs used commercially to spray insecticides and paints; however the observations are deemed pertinent to understanding why and how rotating, i.e. spinning, discs are used in the method and blender of this invention.

The formation of drops leaving from the edge of a spinning disc is analogous in many ways to drop formation leaving from a stationary tip. Liquid flows to the edge of the disc and accumulates until the centrifugal force on the collected mass is greater than the retaining forces due to surface tension, and then the drop is thrown off. Thus, it is reasonable to expect the product of the surface tension and linear dimension of the drop to be proportional to the centrifugal force.

In symbols:

$$\left(\frac{\pi d^3 p}{6}\right)\left(\frac{w^2 D}{2}\right) \propto Td \text{ or rearranging}$$

$$dw\left[\frac{Dp}{T}\right]^{\frac{1}{2}} = \text{constant where}$$

d = drop diameter
p = specific gravity
T = liquid surface tension
D = disc diameter
w = disc angular velocity Extensive experiments by Messrs. Walton and Prewett resulted in an average value for the constant of 3.8, with a range of 2.67 to 6.55. Their experiments also showed, the sharpness or edge profile of the disc was of minor importance. In the range of viscosity investigated, 0.01 to 15 poise, viscosity had little effect on the spraying process, although high viscosity did tend to reduce the maximum flow rate at which homogeneous drops are formed. At small drop sizes, the drops or droplets become airborne, forming a mist.

Mr. Drummond presented his new experimental results showing the effects of flow rate, kinematic viscosity, and spin rate on the drop size and the rate of drip production. Drop volume was shown to exceed the volume predicted by Messrs. Walton and Prewetts' static model, indicating that the dynamics of drop formation must be included in the model.

In the course of perfecting this invention a number of experiments were conducted in which a paper tape was exposed to the spray pattern of spinning discs for a short interval, thus recording the droplet size distribution and spray pattern. Both water and high viscosity, liquid phenol formaldehyde resin were used. Utilizing the equation, and the following parameters: D=250 mm, w=534 rad/s, T=7.3 dyne/mm, and p=1.1, the theoretical drop size was predicted at 0.12 mm as compared to experimental values of 0.20 to 0.30 mm. This agreement was considered satisfactory, as it was noted the drops tend to spread out, rather than retain their spherical shape upon reaching a surface of a particle to be treated.

Figure 2:
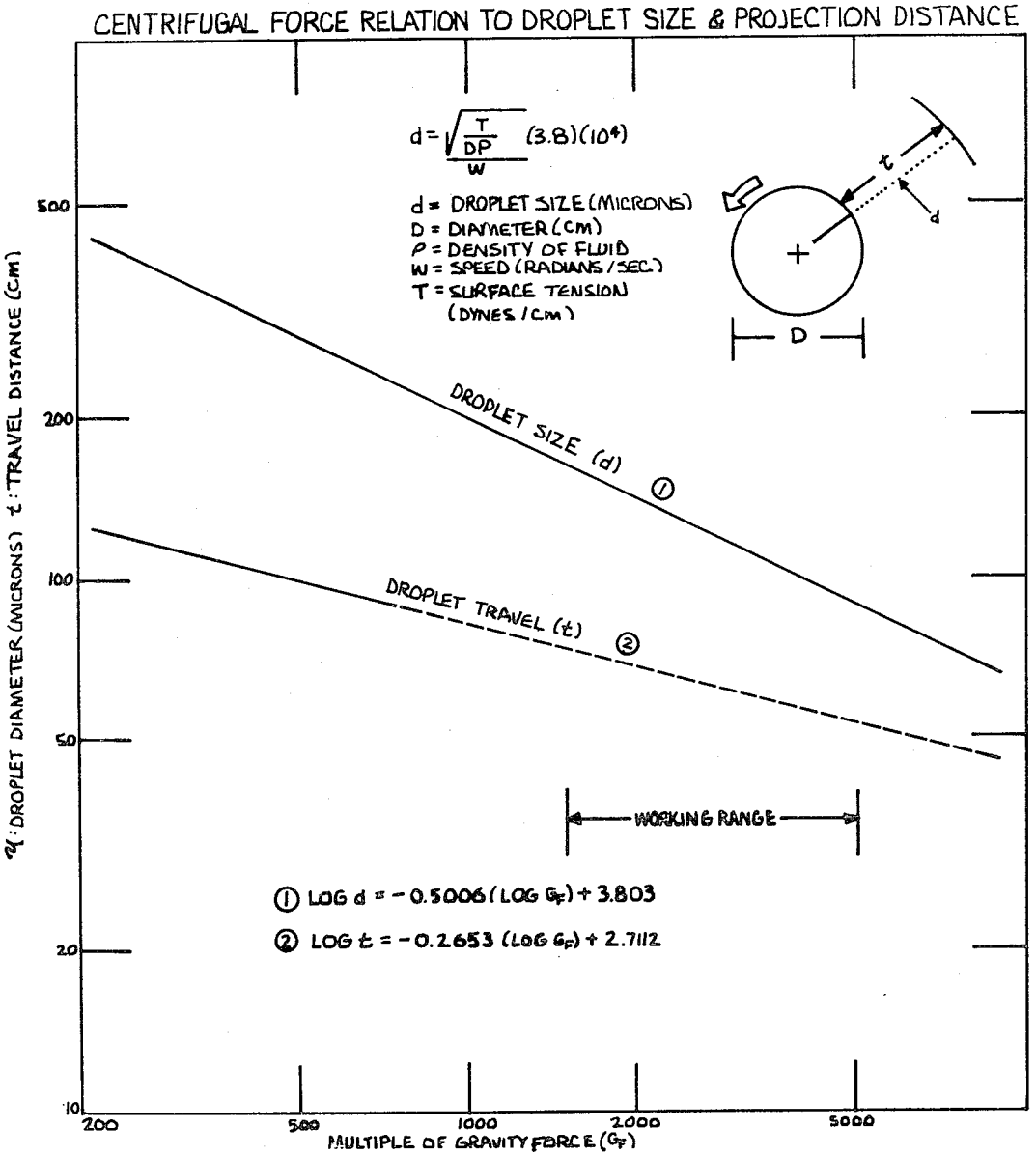
FIG. 2 is a graph illustrating the desirable working range in respect to the size and travel of the droplets of the liquids, such as resin binders and wax emulsions.

In FIG. 2, the liquid droplet size and travel are illustrated in a graph to indicate the working range selected in reference to the method and operation of the blender of this invention. The droplet size portion of the graph has a y ordinate which indicates the droplet size expressed in microns and an x ordinate which indicates the centrifugal force expressed in multiples of the gravitational force. The droplet travel portion of the graph has a y ordinate which indicates the distance of travel in centimeters and an x ordinate which also indicates the centrifugal force expressed in multiples of the gravitational force.

The ideal information observed on the graph and data obtained by experiments indicates the ideal droplet size range is from about 50 microns to 200 microns and the preferred droplet travel range is from 20 centimeters to 90 centimeters, depending on liquid properties and gravity force multiplier at the spray disc rim. The volume per drop may range from 65 times $10^3$ cubic microns to 4200 times $10^3$ cubic microns, which is a sixty four fold range in droplet size. In respect to a preferred embodiment, a spray disc of eleven inches in outside diameter operated at a speed of 3600 rpm causes the droplets of liquid to leave the sharp edge of the spray disc under a force about two thousand times the gravity force.

Figure 3:
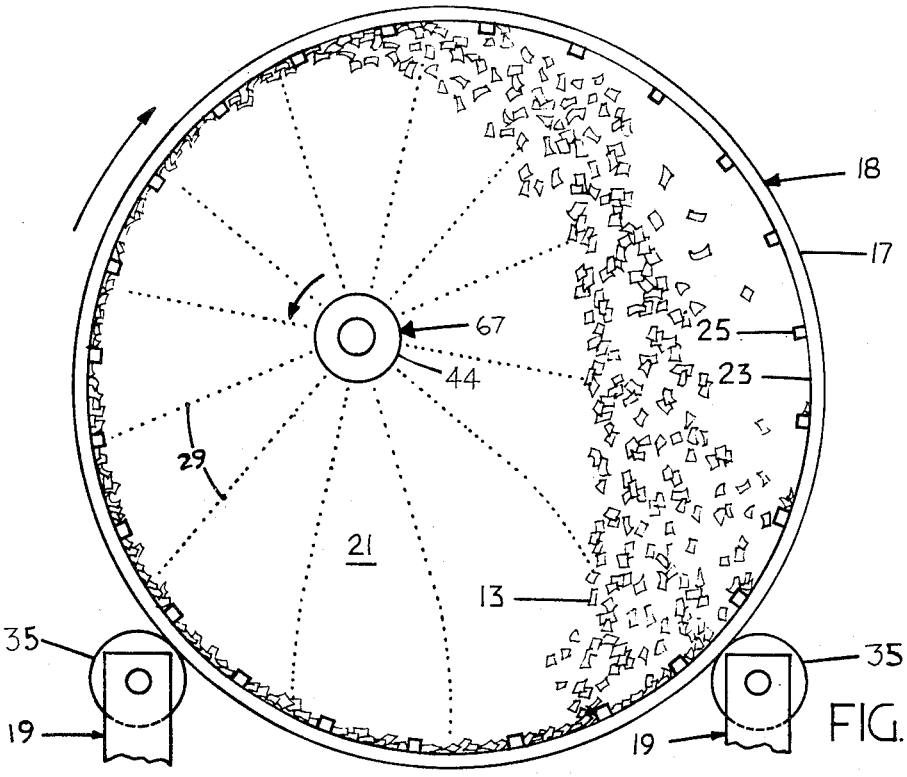
FIGS. 3 and 4 are cross sectional views illustrating the method and apparatus with respect to the rotary lifting of the particles, followed by their free falling in an arcuate cascade, with a spray of droplets originating from a central area of the overall motion path of the particles, also showing different interior surface configurations of the drums.
Figure 4:
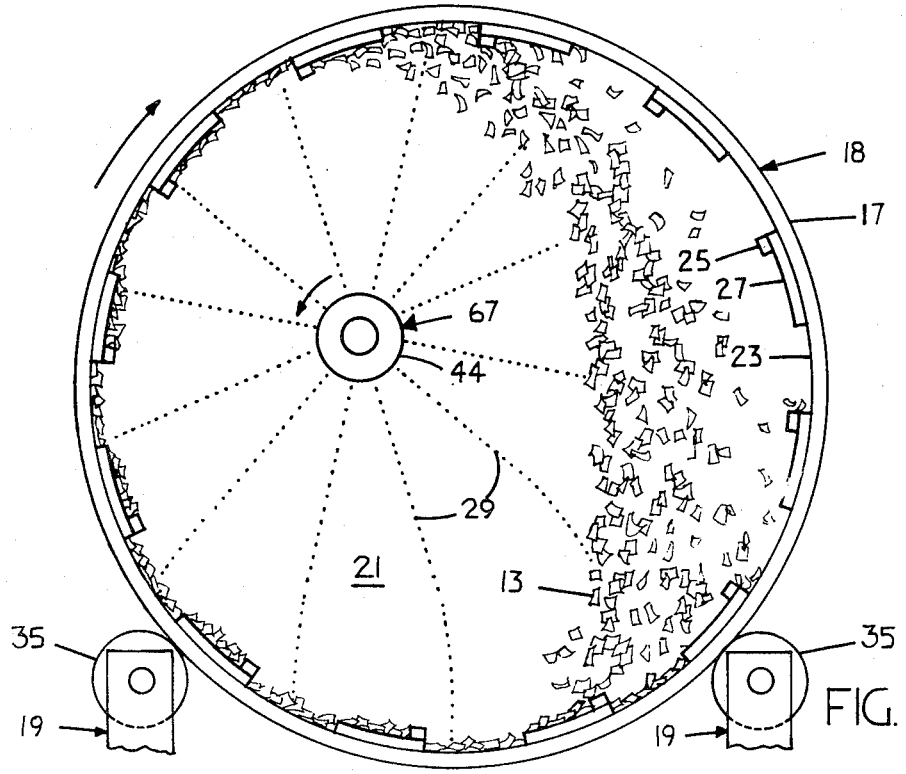

The Controlled Movement of Particles as They are Being Treated With the Sprayed Liquids, Commencing with Rotary Lifting and Then at a Zenith Locale Free Falling in an Arcuate Cascade, With the Spray Coming From Spinning Discs Located on the Central Area Defined by the Overall Movement Path of the Particles In FIGS. 3 and 4, the controlled movement of particles 13 is illustrated as viewed in a transverse section taken through a rotating drum 17 of eight feet in diameter of a blender 18. The drum 17 rotates in a clockwise rotational direction for example, at twenty seven revolutions per minute, when viewed from the entry end, on bearing wheels 35 mounted on an adjustably, tiltable frame 19, shown in part. In a central area 21 or volume of the interior of the drum 17 there are spaced rotating, i.e. spinning, discs 44 which create the spray of droplets of liquids leaving under centrifugal forces such as 1000 or 2000 times the force of gravity, such as resin binders or wax emulsions. The interior walls 23 of the drum 17 are coated with a plastic finish so the particles 13 will not adhere to these interior wall surfaces. Also eventually when cleaning becomes necessary, the plastic covered walls are readily cleaned. Any plastic having a non-stick and wear resistant surface may be used. A polyurethane or Teflon plastic may be used. Therefore, as viewed in FIG. 3, longitudinal ribs 25 are utilized in assisting in the rotary lifting of the particles 13 to compensate when necessary for the effects of a reduced coefficient of friction of the plastic finish. The lands and grooves illustrated in FIG. 4, vary the timing of when the gravitational forces become effective in causing the particles 13 to peel off the drum interior wall and to freely fall in an arcuate cascade, insuring better radial intermixing of the particles as they traverse the blender.

As illustrated in both FIGS. 3 and 4, the particles 13 are rotary lifted while positioned adjacent to the interior wall 23 of the drum, until gravitational forces become effective in causing the particles 13 to peel off the drum interior wall and freely fall in an arcuate cascade until reaching again the interior wall 23 at a lower point to begin another cycle. Each respective spinning disc is located, in reference to a particular transverse cross sectional view, within the central area defined by the overall movement of the collective particles 13. As observed in FIGS. 3 and 4 the sprayed droplets 29 reach the particles without any appreciable amount of them escaping on through to unwantedly contact the interior wall 23 of the blender 18.

Figure 5:
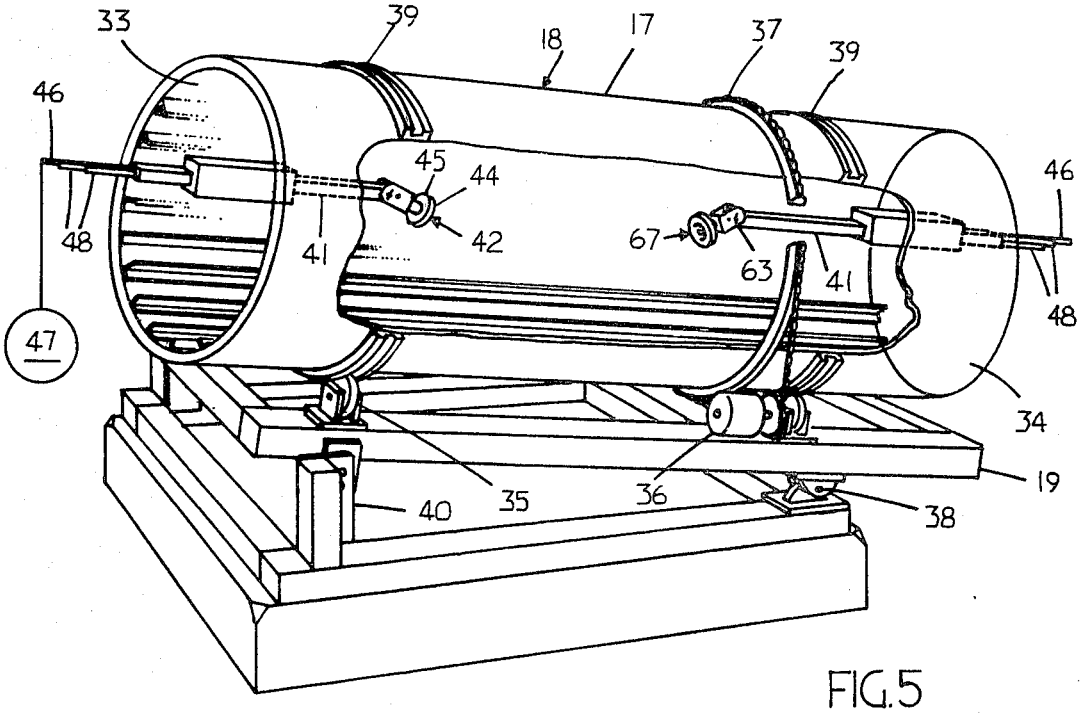
FIG. 5 is an isometric view of a preferred embodiment of the blending apparatus, i.e. the blender, with portions removed for illustrating the interior of the drum, and the arrangement of the cantilevered shafts and their tiltable discs, which are powered to create the spray of liquids.

The Additional Controlled Movement of the Particles, Under Treatment to Move Them on Through the Blender, While Being Sprayed With Liquids In FIG. 5, the longitudinal observation indicates the drum 17 of the blender 18 rotates about a near horizontal axis, with the entry end receiving the particles 13 being higher than the exit end discharging the particles 13. The retention time of the particles 13 in the blender 18 is controllable by adjusting the angle of the inclination of the blender's longitudinal axis. Generally depending on the inclination angle the particles make from twenty to sixty revolutions, while being treated in the blender 18. For example in an eight foot diameter blender twenty feet long a one minute retention time when the drum 17 is rotating at twenty-seven revolutions per minute, requires an inclination angle of about five and one third degrees.

In reference to the rotational speed of the drum 17 of a blender 18, under some circumstances, as the particles, such as wood wafers, for example, acquire resin binder on their surfaces, the drum speed preferably has to be gradually decreased to achieve the most desirable cascading free falling action of the particles 13 because of the increased coefficient of friction of resinated particles. Therefore, in reference to the entire length of a drum 17, and realizing as the particles progress from the entry to the exit they gain in their receipt of resin binder, the peripheral or circumferential speed may be progressively reduced to suit specific resin application conditions by utilizing interchangeable liners.

The drum 17 has inlet and discharge openings 33, 34 respectively. It is supported by two sets of wheels 35 that turn against outer flanged rings 39 which are welded to the exterior of the drum 17. A variable speed motor 36 drives chain 37 that encircles the drum 17. The speed of the drum 17 is precisely adjusted to provide optimum free falling arcuate cascading of the particles 13 throughout their passage through the drum 17. Their retention time is controlled by changing the angle of inclination of the longitudinal axis of the drum 17. The blender adjustable support frame 19 is pivoted on axle 38 at its lower discharge end. Its higher entry end is raised and lowered by using mechanism 40 to achieve the amount of tilt.

In regard to setting the retention time, by way of example, for a drum of eight feet inside diameter by twenty feet long operated at twenty-seven revolutions per minute, a sixty second retention time requires about twenty-two inches of elevation for this twenty foot long drum 17, thereby obtaining a five and three tenths degree angle of inclination. When the angle of inclination is changed to three and five tenths of a degree, which is about fifteen inches of elevation at the entry end, then the particle retention time is ninety seconds.

In respect to each end of the blender 18, hollow cantilevered tubes 41 or nonrotating shafts, project inwardly about five feet. On each shaft 41, an assembly 42 of a hydraulic motor 43 and paired discs 44, 45 are tiltably mounted and preferably positioned at a forty-five degree angle with respect to the longitudinal axis of the drum 17. The circular sprays of droplets dispersed by these spinning discs 44, 45 project from the respective near end of the drum 17 to about the middle of the interior of the drum 17. The preferred positioning of the discs 44, 45 at each end of the drum 17 will vary depending on a specific set of a manufacturing mill's conditions. Preferably the position of the spinning spray discs 44, 45, as viewed transversely in a drum 17 rotated clockwise when viewed from the entry end, is above the drum axis and also to the left of a vertical centerline.

The spray discs 44, 45, receive their liquids, such as resin binders or wax emulsions, from a tube 46 leaving a variable delivery pump 47. The hydraulic motor 43 is supplied with oil through conduits 48. Both the liquid tube 46, and oil conduits 48, continue on into the interior of the hollow cantilevered tube or shaft 41.

The overall size of any embodiment will govern in many respects the number and positioning of spray discs, from one spray disc, i.e. one single spraying surface and rim, to several spray discs arranged in different assemblies of 1, 2, 3 or more spray discs, and selectively spaced within a drum.

Figure 6:
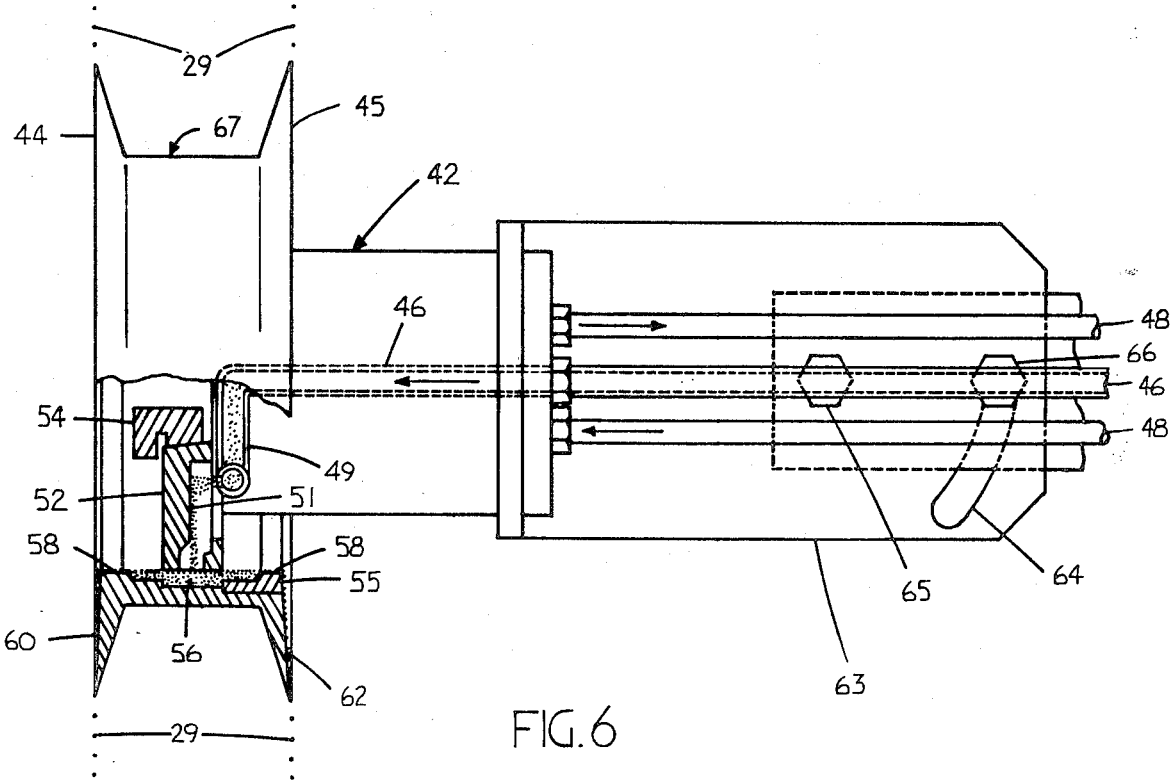
FIG. 6 is a partial side view with portions removed for illustrative purposes to illustrate the angularly adjustable mounting to facilitate the changing of the rotational plane of the spinning discs relative to the longitudinal direction of the cantilevered shaft on which the discs are rotatably mounted, with arrows indicating the flow of liquids enroute from the interior of the shaft to the rims of the disc for departure in a uniform spray of droplets.
Figure 7:
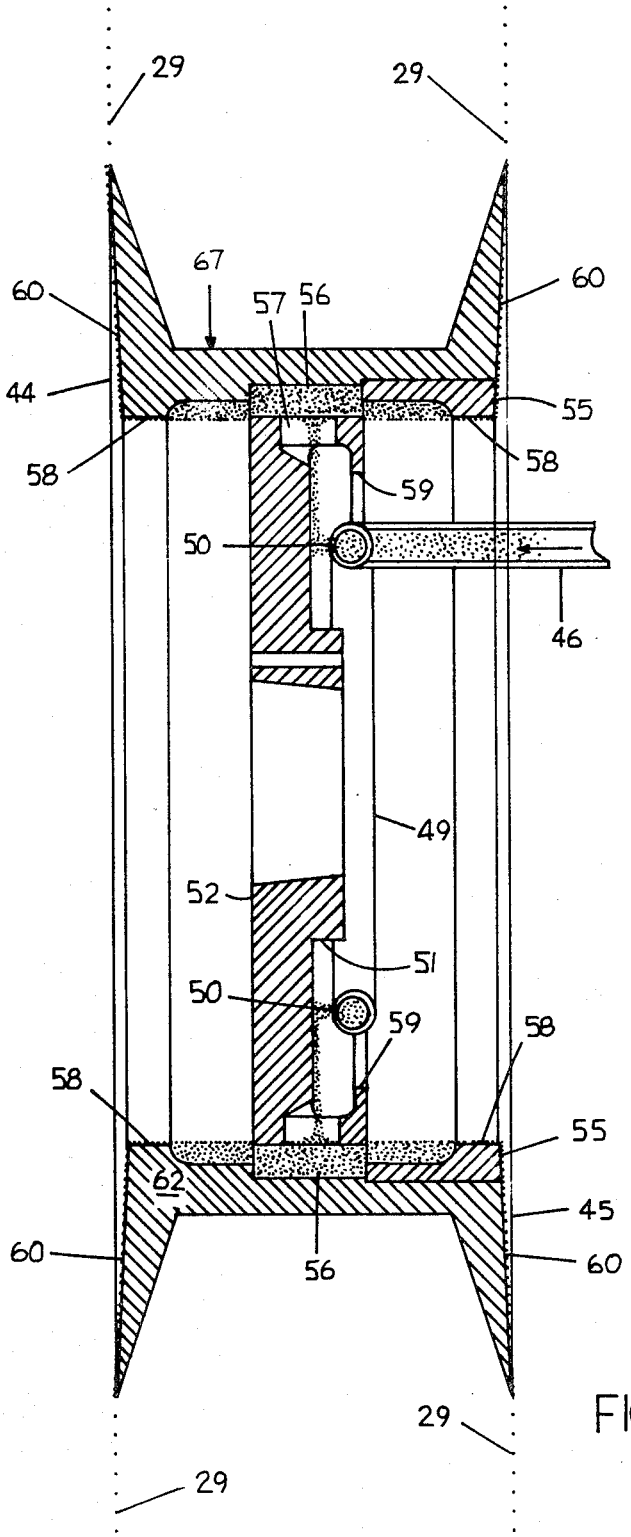
FIG. 7 is an enlarged cross sectional view of the dual discs indicating with arrows the flow of liquids enroute to rims of the spinning spray discs.
Figure 8:
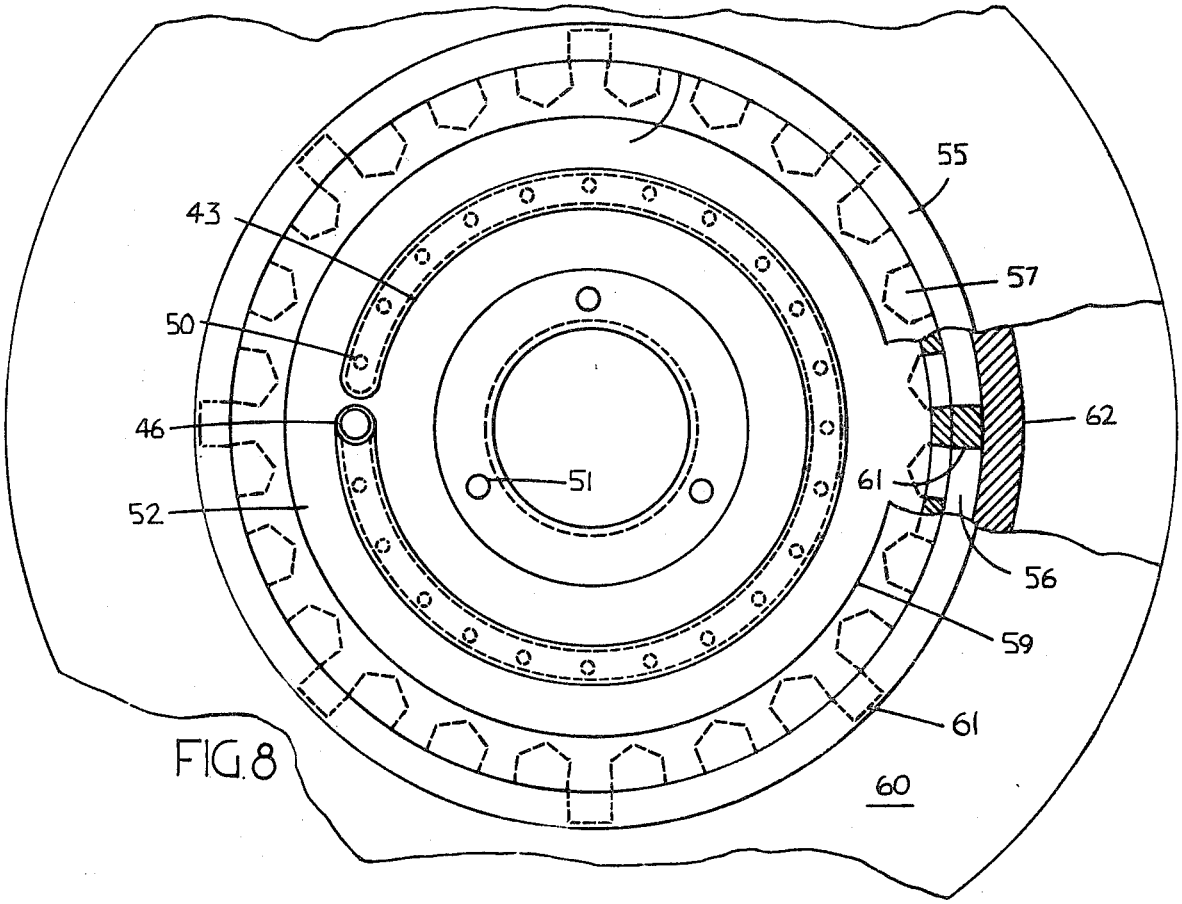
FIG. 8 is a transverse view, somewhat schematically indicating the central portions of the rotating discs and their hub or central web plate, to further indicate the flow of liquids enroute to the rims of the spinning spray discs shown in FIGS. 5 through 7.

The Distribution of Liquids, Such as Resin Binders, and Wax Emulsions to the Paired Powered Spinning Discs Tiltably Mounted to the Cantilevered Tubes or Shafts In FIGS. 6, 7, and 8, the distribution of the liquids to the paired powered spinning discs is illustrated. In FIG. 6, more of the details of the assembly 42, of the hydraulic motor 43 and the paired discs 44, 45 are shown. The liquid supply line or tube 46 is positioned in the interior of the cantilevered tube or shaft and then via a flexible section is thereafter firmly positioned on the housing of the hydraulic motor 43. This supply line 46 terminates at an annular tube ring 49. Throughout this ring 49 are a series of evenly spaced small holes, i.e. orifices 50, which direct the liquid, i.e. resin binder or wax emulsion, against the spinning recessed face of a hub or central web plate which is locked to a drive shaft 53 of the motor 43 by a tapered bushing. The liquid film on the hub 52 flows radially outwardly into the circular center pool of liquid 56. In operation this pool flows over dams 58 and onto disc faces 60 and then off the disc edge into a spray of droplets 29. The disc body 62 has two stepped lands on its inner rims. One land aids the formation of liquid pool 56 and is interference fitted with the hub 52. Dam ring 55 is interference fitted into the second land.

To insure identical radii on the surfaces of dams 58, they are machined to final dimension after assembly.

The hydraulic motor 43 powering the spinning discs 44, 45 is attached to the cantilevered tube or shaft 41 using the multiple piece tiltable bracket assembly 63. By utilizing slot 64, pivoting bolt fastener 65 and locking bolt fastener 66 this assembly 63 is lockable at various angular or tiltable positions.

In FIG. 7, this two disc spray head 67 having discs 44, 45 is shown in more detail. The degree of separation between the discs 44, 45, i.e. their rims, is critical. If they are one and fifty hundredths of an inch apart the droplets 29 merge into a single dense spray, twenty to thirty-six inches beyond the rims of the discs. However, when the discs were spaced three and fifty hundredths of an inch or further apart, the spray rings did not merge.

In FIG. 8, a transverse view, partly schematic, indicates further the distribution of the liquid to the discs 44, 45, involving the hub or central web plate 52. Blind holes 57 are radially drilled inwardly to connect with the shallow circular cavity or recessed face 51 on the face of the web plate 52. An inwardly projecting lip 59 on web plate 52 contains any side flow of liquid from the recessed face 51 and deflects such possible flow radially outward into the liquid pool 56. The centrifugal force at the radius of lip 59 is about one thousand times gravity.

To assemble the disc body 62 to the hub or central web plate 52, projecting lugs 51 on web plate 52 are precisely machined for interference fit into the disc body 52, i.e. inner rims of the disc head.

Figure 9:
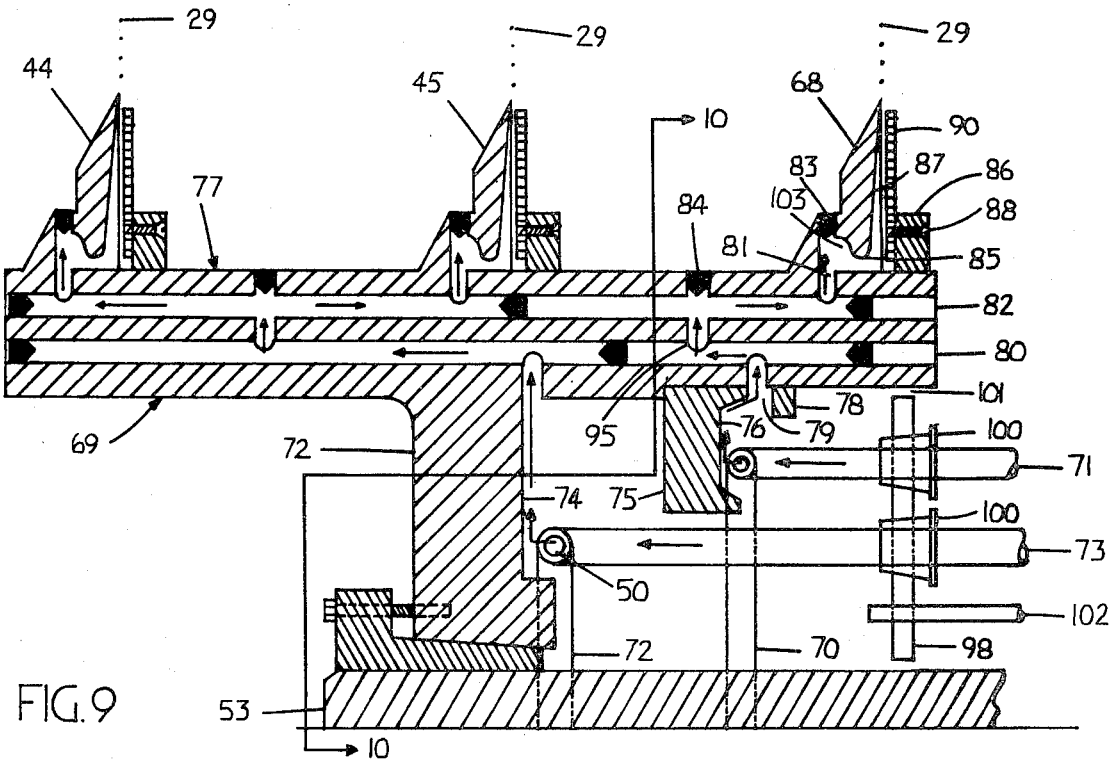
FIG. 9 is a partial longitudinal sectional view of an embodiment of a mounting of three spinning spray discs utilizing two different liquids, such as a resin binder and a wax emulsion which are sprayed at the same time to reach the particle surfaces in droplet form.
Figure 10:
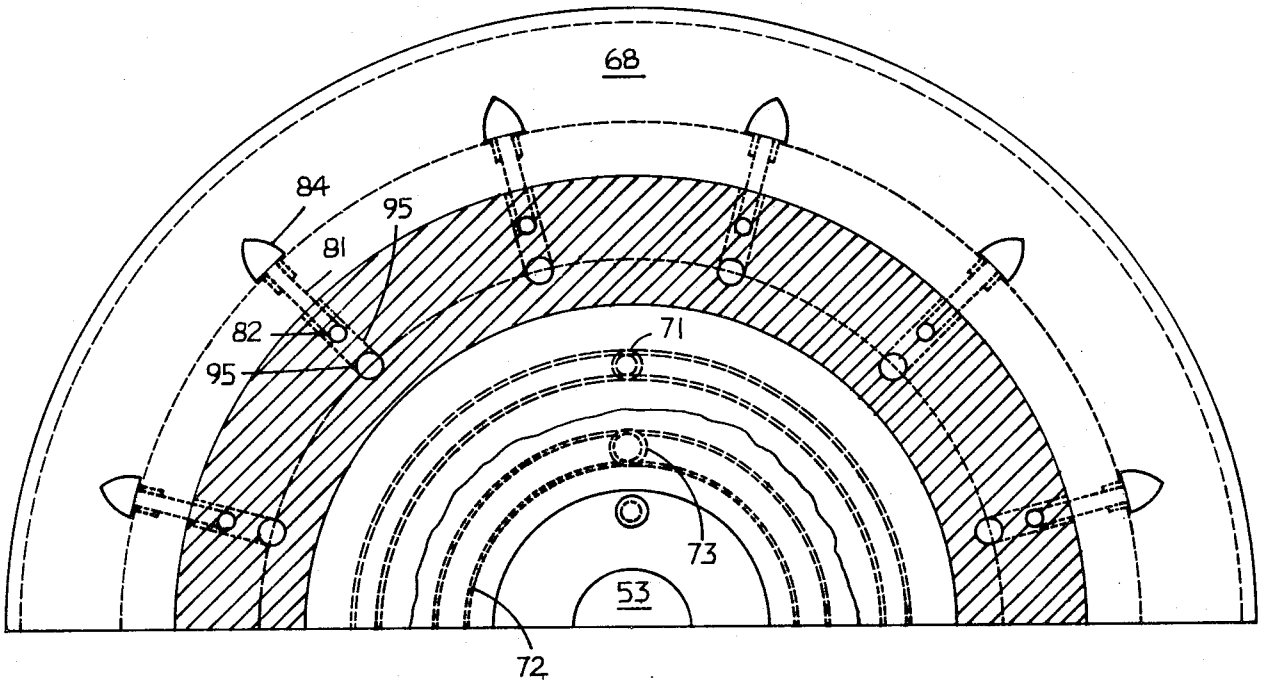
FIG. 10 is a transverse view, somewhat schematically indicating the selected central portion of and nearby one of the spinning spray discs shown in FIG. 9, to further indicate the distribution of one of the liquids.

The Feeding or Supplying of Two Liquids to a Spray Head Having Multiple Spinning Discs, for Example Spraying Resin Binder and a Wax Emulsion In FIGS. 9 and 10, the feeding or supplying of two liquids, such as resin binder and wax emulsion to multiple spinning discs 44, 45, 68 on the same spray head 69 is illustrated. The two fluids, resin binder R, and wax emulsion W, are distributed through the annular tube ring 70 being supplied with wax emulsion W via the tube 71, and the second annular tube ring 72 being supplied with resin binder R, via tube 73. The respective liquids W and R, are directed from these tube rings 70, 71 through holes or orifices 50 like those in the annular tube ring 49 shown in FIGS. 6 and 7. The departing jets of fluids R and W, strike the rapidly turning surface structures 74 and 76 respectively.

The recessed surfaced ring collar 75 which presents the surface structure 76, is interference fitted onto the cylindrical surface of the overall disc body or disc head 77. A liquid retaining ring 78 is similarly fitted thereafter at a spaced location. The wax emulsion W flows radially outwardly forming a circular pool at 79, which is intersected at twelve radially spaced longitudinally directed deep holes or passageways 80. These passageways 80 are threaded throughout their length to accept solid sealing plugs 84. A ring of twelve blind holes 95, interconnect, i.e. intercept, both passageway 80 and a parallel passageway 82. The outer ends of holes 95 are also then blocked by plugs 84. Liquid W after passing through the pool area 79, passageway 80, hole 95, then travels through passageway 82 to reach access holes 81. These holes 81 are drilled on the back side of disc 68 only to meet passageway 82, and after drilling plugs 83 are inserted. The wax emulsion W, forms a continuous annular pool in the shallow undercut groove 103 which also intersects with holes 81. The overflow from this annular pool passes over the inner lip 85 onto the conical disc face 87 of disc 68 creating a uniform distribution of a liguid which flies off the rim of the disc 68 in a spray of fine droplets 29. When necessary a wind and dust shield 90 is used to protect the uniform distribution of the liquid before its departure from the spinning disc. This shield 90 is preferably made and assembled in two parts with a circular collar ring 86 also originally in parts. This shield assembly is firmly clamped to the disc head or body 77. The shield 90 and collar ring 86 are joined at radial locations by fasteners 88.

The liquid resin binder R, follows similar paths and goes through like holes and passageways and collects in like pools to reach the two discs 44, 45. Utilizing passageway 82 and properly spacing the plugs 84, liquid R goes in both axial directions to reach the respective spaced discs 44, 45, in contrast to liquid W which via passageway 82 has only access to disc 69.

As Necessary the Utilization of an Axial Assembly of a Shield to Keep Dust and Debris From Getting into the Liquids as They are Being Distributed to the Discs Under some conditions of overall design, and/or operations there is as may be necessary, the need for an axial shield assembly 98, which is also illustrated in FIG. 9. This shield 98 is stationary being eventually mounted on the nonrevolving structure of the motor frame, not shown in FIG. 9. Immediately this shield 98 is supported on the tube 71 to supply liquid W and the tube 73 to supply liquid R using bushings 100. A clearance of about 0.050 of an inch is maintained at the shaft 53 and at the gap 101 adjacent to the inside wall of the hub 77. Through a small tube 102 a controlled flow of clean air is adjusted in flow to create a positive pressure while the disc hub 77 is spinning. The maintenance of this positive pressure assures there will be a clean, dust free region where the liquids R and W are exposed to the air before getting to the disc surface 87.

In FIG. 10, a partial half transverse view is presented to help in the understanding of the flows of liquids R and W, as discussed with respect to their flows illustrated in FIG. 9. About drive shaft 41 is a tapered bushing 88. The other features illustrated in this FIG. 10, concern the disc 68, but are also features of discs 44, 45 as they are used in this embodiment. There are twelve longitudinal passageways 80, referred to as the primary distribution channels, and there are twelve longitudinal passageways 82, referred to as the secondary distribution channels. They are selectively interconnected at spaced locations by blind holes 95. Holes 81 interconnect passageway 82 to the disc 68. Both holes 81 and 95 after drilling receive end plugs 81, 84, not shown in this FIG. 10. The gothic arch shape 84 in this FIG. 10 is created by an end mill cut into the back side of the disc 68 to provide a flat entry surface for drilling the hole 81.

Figure 12:
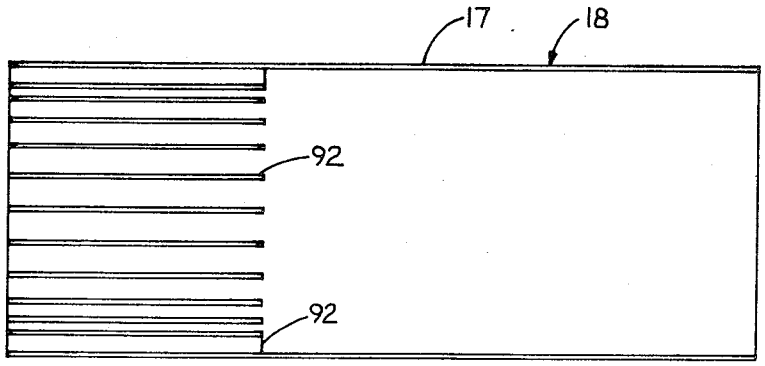
FIG. 12 is a partial longitudinal sectional view indicating the installation of the longitudinal particle lifters, as also shown in FIG. 11, which are installed at equally spaced radial intervals throughout the first third of the length of the interior of the blender.
Figure 11:
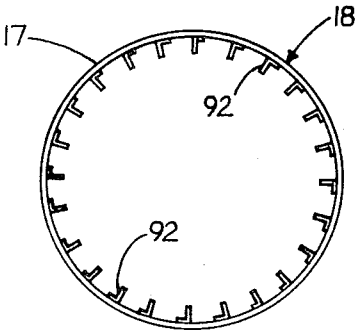
FIG. 11 is a partial transverse sectional view indicating the loading end of another embodiment of a blender wherein longitudinal particle lifters are installed at equally spaced radial intervals throughout the first third of the length of the interior of the blender.

Lifters Used in Portion of the Interior Length of the Drum of the Blender to Enhance the Cascading Movement of the Particles Until They Become Sufficiently Tacky Often when particles 13 are very light and dry, lifters 92 are utilized, as illustrated in FIGS. 11 and 12, throughout the first portion, for example the first one third of the length of the interior of the drum 17. Preferably, the lifters 92 extend longitudinally at equally spaced radial intervals. Preferably they are angular in cross-section, with one flange serving as the particle lifter and the other flange serving as a mounting flange adjacent to the interior of the drum. By way of example in an eight foot diameter drum, twenty feet in length, the lifters project six inches into the drum and are seven feet in length. The lifters may be tapered in height with the furtherest projecting portion on the end nearest the entrance end.

Figure 14:
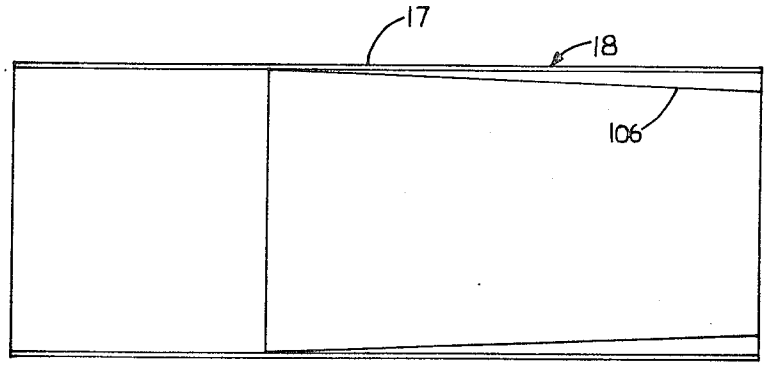
FIG. 14 is a partial longitudinal sectional view illustrating the tapering interior of a blender, as also shown in FIG. 13, wherein two thirds of the interior length is tapered.
Figure 13:
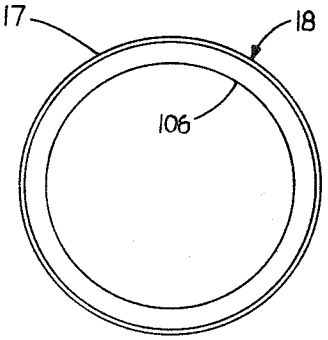
FIG. 13 is a partial transverse sectional view illustrating the tapering interior of another embodiment of a blender as viewed from the loading end.
Figure 15:
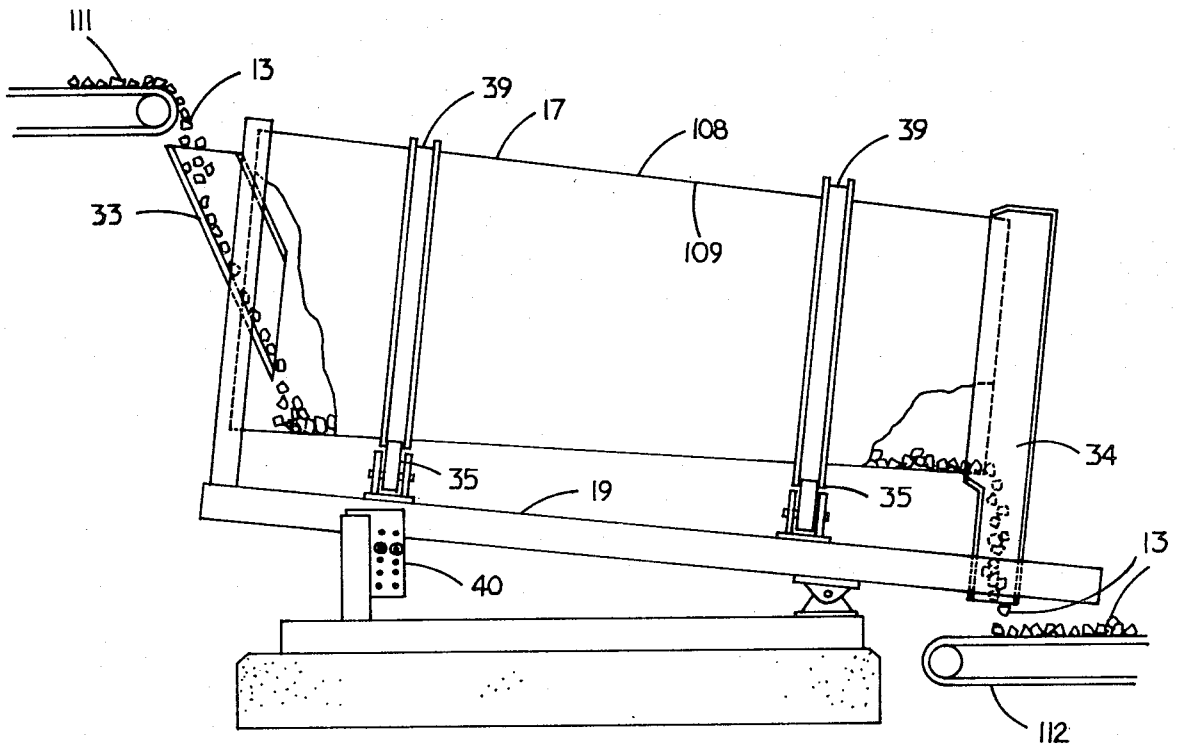
FIG. 15 is a partial, somewhat schematic longitudinal view, with some portions removed, illustrating another embodiment of a blender, wherein the entire drum is tapered to provide a tapered interior throughout the length of the blender, and also illustrating how this blender embodiment, as well as all blender embodiments, is loaded with particles and how this blender, as well as other blenders, are unloaded with respect to the particles, which have been sprayed with droplets of liquid.
Figure 16:
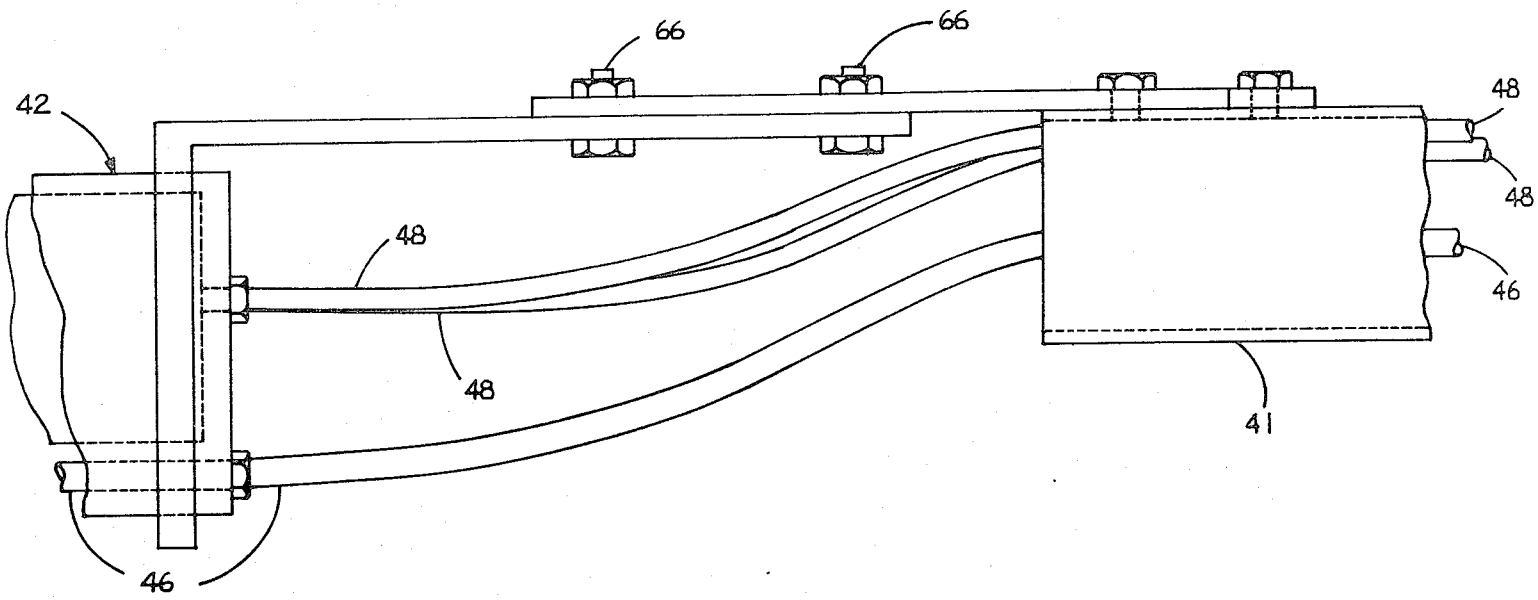
FIG. 16 is a partial top view, with some portions removed, supplementing FIG. 6, to further illustrate the angularly adjustable mounting to facilitate the changing of the rotational plane of the spinning discs relative to the longitudinal direction of the cantilevered shaft on which the discs are rotatably mounted.

Tapering the Interior of the Drum of the Blender to Maintain the Cascading Movement of the Particles as They Gain in Tackiness As particles 13 gain in tackiness from receiving droplets 29; i.e. the coefficient of friction increases, in order to continue the desired radial point of beginning of the cascading of the particles 13, i.e. the peel off point, the circumferential speed of the drum wall must be reduced. Therefore a tapered interior section 106 or insert, shown in FIGS. 13 and 14, is installed within a drum 17. This accomplishes this reduction of the circumferential speed, without reducing the overall revolving speed of the drum 17 of the blender 18. Preferably the tapered section extends for the latter two thirds of the drum length. An alternative arrangement to this embodiment is shown in FIG. 15 wherein the entire drum is tapered for its full length rather than using an insert. By way of example, for the application of resin to dry wood wafers to a 4 percent final resin content in a drum running at 27 rpm, the drum would be tapered so there was a 96 inch inlet diameter and a 91 inch outlet diameter for a drum twenty feet in length. The actual amount of taper in any application would depend on the parameters of the particular application; such as, particle tackiness, liquid content, drum length, drum diameter, speed of rotation.

Use of Lands and Grooves to Effect the Mixing of Particles and the Peel Off Point and Ribs to Move the Particles The interior of the drum 17 may be divided into sections having a different effective diameter. This may be done by the addition of lands 27 as shown in FIG. 4. These lands define grooves 23 between the lands which have an effective diameter greater than the surface of the lands. This results in the peel off point, where the cascading of particles begins, for particles 13 resting on the lands to be different from that for the particles 13 resting on the grooves. This creates a turbulence which enhances the mixing action of the cascading particles. The lands, and grooves, perferably would extend the full length of the drum, but need not do so.

In addition to the lands and grooves an anti-slip rib 25 like that shown in FIGS. 3 and 5 may be secured to one edge of the land, as shown in FIG. 4. The anti-slip rib preferably runs the full length of the drum also. These ribs serve to start the particles moving with the drum wall. In their preferred form the ribs are approximately two inches in height and extend for the full length of the drum.

Loading and Unloading of the Particles with Respect to the Drum of the Blenders As illustrated in FIG. 15, an embodiment of the loading and unloading of the particles 13 with respect to the drum 17 of the blender 18 includes loading and unloading conveyors 111, 112. Inlet opening 33 receives the particles 13 being discharged from loading conveyor 111, and the particles 13 with the droplets 29 leave discharge opening 34 to reach the unloading conveyor 112. End panels of the drum, which support the inlet opening structure 33 and the discharge opening 34, are stationary at all times, as only the cylindrical portions of the drum 17 rotate during the blending operations.

Figure 18:
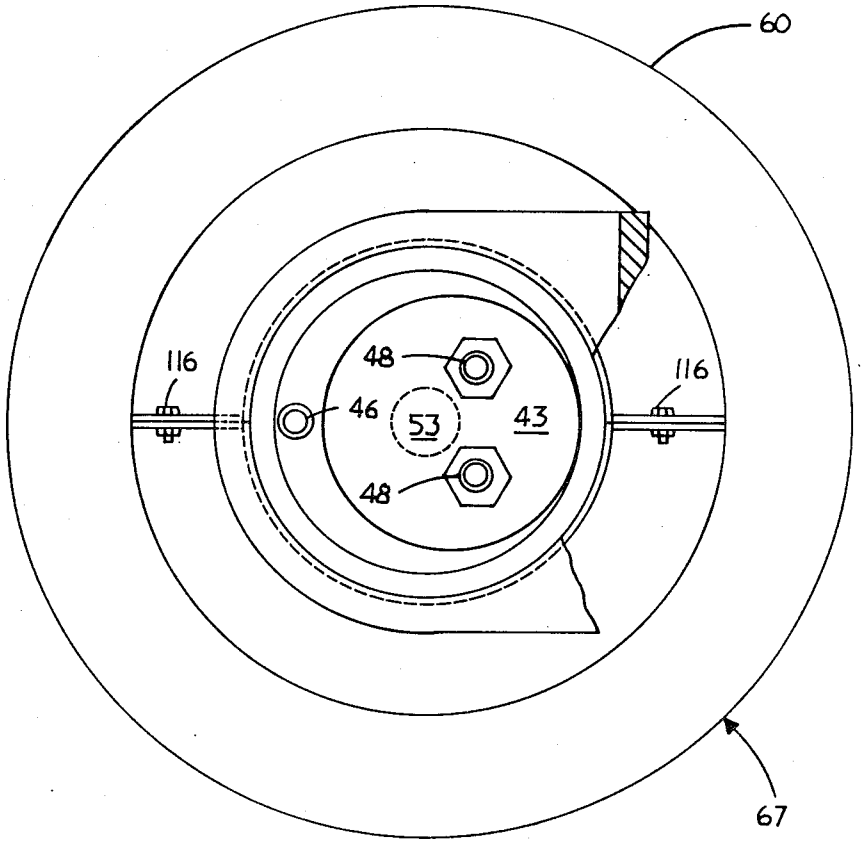
FIG. 18 is a partial view, with some portions removed, supplementing FIG. 18, to illustrate how the stationary wind and dust shield is made and secured in place.
Figure 17:
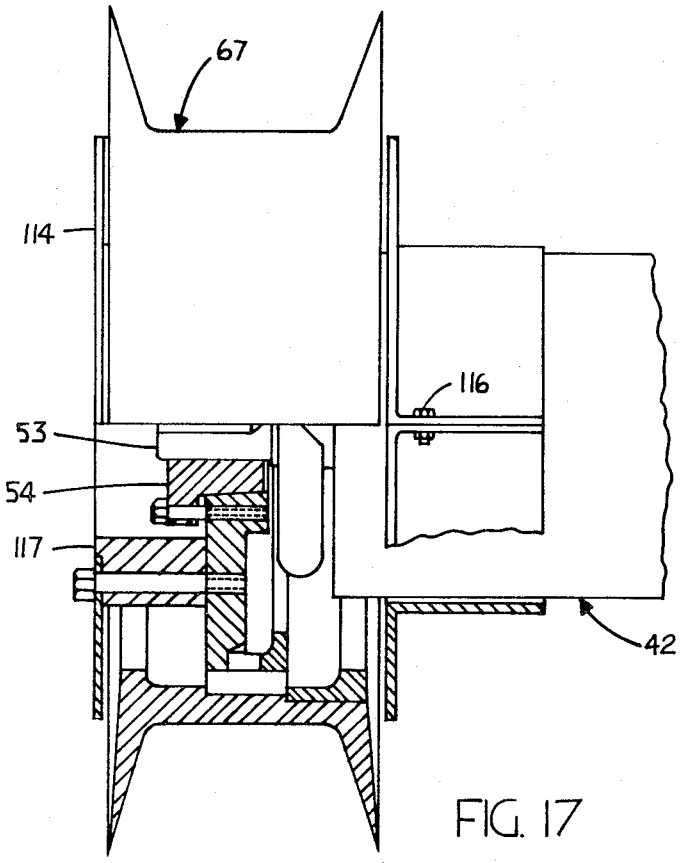
FIG. 17 is a partial view, with some portions removed, of the dual spray discs, also shown in FIG. 7, to illustrate how wind and dust shields are mounted, in this embodiment, and also are mounted in other embodiments, one shield being held stationary and the other shield rotating with the discs, to protect the liquid as it travels to the rims of the spray discs.

Wind and Dust Shields to Protect Liquids Radially Moving to the Rims of the Spraying Discs As illustrated in FIGS. 17 and 18, wind and dust shields 114, 115 are utilized to protect the liquids as they radially move to the rim of the conical disc faces 60 of the discs 44, 45. The shield 115 and its associated attachment flange are made in respective half subassemblies and joined by fasteners 116. In FIG. 17, one of the shields 114 and its mounting ring 117 is secured for rotation with the disc and the other shield 115 is secured to non-rotating parts as shown in FIG. 18.

Other Observations Regarding the Movement of the Particles Around and Through the Drum of the Blender Although the cascade of particles, wafers and flakes is reasonably turbulent it was observed that if disc rotation was opposite to drum rotation the windage from the discs tended to enhance the particle mixing. This better mixing is desirable to counteract or avoid any tendency for any possible concentric stratification of the particles as they repeatedly circle inside the drum of the blender.

In respect to another aspect, in order to minimize any resin adherence to the drum wall a very smooth plastic coating is applied to the inner drum surface. However the untreated dry wafers or particles slide easily on this surface. Therefore it is necessary to place strips, on about twelve inch spacings, parallel to drum axis to prevent excessive and erratic slippage of the wafers or particles. These rib like strips are not serving as lifting vanes, since the bulk of the wafers or particles are retained in a uniform layer about one to two inches thick between the rib like strips rather than piled in a triangular shape on the forward face of any rib like strip.

It may also be desirable, in a cylindrical drum blender to employ lifting vanes on the entry end of the blender to ensure initial optimum cascading action of low resin content (0–2%) wafers. These vanes extend longitudinally not more than one third the length of the drum and are parallel to the drum axis.

We claim:

1. A blender used to effectively apply finely dispersed liquid droplets of resins and/or waxes, throughout surfaces of particles, comprising:

(a) a hollow drum having an inlet end and an outlet end which is rotatably supported on a frame and downwardly inclined at a small angle to the horizontal from its higher inlet end;

(b) a variable speed drive assembly to rotate the hollow drum at selectable optimum speeds to produce along its upwardly moving inner wall a thin layer of particles which leave and fall from the inner wall a small distance before reaching the uppermost peripheral point of travel to produce a free falling cascade of particles which is sufficiently dense to form an impervious curtain spaced from the downwardly moving inner wall of the hollow drum;

(c) a particle receiving assembly at the inlet end of the rotatable hollow drum;

(d) a particle discharging assembly at the outlet end of the hollow drum;

(e) at least one cantilevered shaft extending longitudinally into the drum from an end of the drum;

(f) at least one spray disc sprayer oriented angularly with respect to the drum axis and mounted on the end of the cantilevered shaft above and offset from the longitudinal axis of the drum;

(g) a power assembly mounted on the end of the cantilevered shaft to operate the spray disc sprayer such that spray is disposed in a full circular arc to simultaneously strike and impinge on both the thin layer and the dense cascade of particles without passing therethrough to the inner wall; and (h) a liquid supply assembly connected to the spray disc sprayer, to deliver liquid thereto while the particles are being delivered to and removed from the rotating hollow drum.

2. A blender used to effectively apply finely dispersed liquid droplets of resins and/or waxes, throughout surfaces of particles, as claimed in claim 1, comprising, in addition, an adjustable frame to rotatably support the hollow drum at selective angles from a horizontal axis.

3. A blender used to effectively apply finely dispersed liquid droplets of resins and/or waxes, throughout surfaces of particles, as claimed in claim 2, wherein the power assembly is secured to the cantilevered shaft which does not rotate, and the power assembly directly drives the disc sprayer.

4. A blender used to effectively apply finely dispersed liquid droplets of resins and/or waxes, throughout surfaces of particles as claimed in claim 3, wherein the liquid supply assembly delivers the liquid to the side of the spray disc sprayer.

5. A blender used to effectively apply finely dispersed liquid droplets of resins and/or waxes, throughout surfaces of particles, as claimed in claim 4, wherein the spray disc sprayer is arranged as paired disc sprayers with a space between the paired discs being wide enough so the departing sprays of droplets will not converge.

6. A blender used to effectively apply finely dispersed liquid droplets of resins and/or waxes throughout surfaces of particles, as claimed in claims 1, 2, 3, 4, or 5, wherein each spray disc sprayer is pivotally mounted on the cantilevered shaft to direct liquid sprays in transverse planes at angles with respect to the cantilevered shaft.

7. A blender used to effectively apply finely dispersed liquid droplets of resins and/or waxes, throughout surfaces of particles, as claimed in claims 1, 2, 3, 4, or 5, wherein the liquid supply assembly supplies two different liquids delivering one liquid such as a resin to one spray disc of a sprayer and another liquid such as a wax to another spray disc of a sprayer.

8. A blender used to effectively apply finely dispersed liquid droplets of resins and/or waxes, throughout surfaces of particles, as claimed in claims 1, 2, 3, 4, or 5, wherein the cantilevered shaft on which the spray disc sprayer is mounted is positioned within one upper transverse quadrant of the hollow drum.

9. A blender used to effectively apply finely dispersed liquid droplets of resins and/or waxes, throughout surfaces of particles, as claimed in claims 1, 2, 3, 4, or 5, wherein the hollow drum includes means to selectively reduce the peripheral speed at the interior surface of the hollow drum at selective longitudinal places along the hollow drum, to compensate for the increasing coefficient of friction as the particles gain more resin making their surfaces increasingly tackier, and thereby maintain the cascading of the particles.

10. A blender used to effectively apply finely dispersed liquid droplets of resins and/or waxes, throughout surfaces of particles, as claimed in claims 1, 2, 3, 4, or 5, wherein the drive assembly rotates the hollow drum in one direction and the power assembly rotates the spray disc sprayer in the opposite direction.

11. A blender used to effectively apply finely dispersed liquid droplets of resins and/or waxes, throughout surfaces of particles, as claimed in claims 1, 2, 3, 4, or 5, wherein the cantilevered shaft on which the spray disc sprayer is mounted is positioned within the upper transverse quadrant of the hollow drum in which the raising of the particles is undertaken, and the hollow drum is rotated at a selected angle relative to the horizontal plane and at a selected speed to create a selected number of cycles, wherein in each cycle, the particles are lifted along the interior surface of the hollow drum to an upper zenith locale within the hollow drum, where the gravitational force becomes effective to cause the particles to freely fall in an arcuate cascade down to the interior surface of the hollow drum.

12. A blender used to effectively apply finely dispersed liquid droplets of resins and/or waxes, through surfaces of particles, comprising:

(a) a hollow drum rotatably supported on a frame for rotation about a downwardly inclined axis and having nonrotatable ends;

(b) a variable speed drive assembly to rotate the hollow drum at selectable optimum speeds to produce along its upwardly moving inner wall a thin layer of particles which leave and fall from the inner wall a small distance before reaching the uppermost peripheral point of travel to produce a free falling cascade of particles which is sufficiently dense to form an impervious curtain spaced from the downwardly moving inner wall of the hollow drum;

(c) a particle receiving assembly at the higher end of the rotatable drum;

(d) a particle discharging assembly at the other end of the drum;

(e) hollow nonrotatable cantilevered shafts positioned longitudinally within the hollow drum and extending from each end thereof;

(f) spray disc sprayers rotatably mounted respectively on the ends of the cantilevered shafts inside the hollow drum;

(g) power assemblies mounted respectively on the ends of the cantilevered shafts to rotate the respective spray disc sprayers to create spraying gravity forces of one thousand; and (h) a liquid supply assembly connected to the shaft for delivering liquid to the spray disc sprayers, while the particles are being delivered and removed from the hollow rotating drum.

13. A blender as claimed in claim 12, comprising, in addition, an adjustable frame to rotatably support the hollow drum at selective angles from a horizontal axis.

14. A blender as claimed in claim 13, wherein the liquid supply assembly delivers the liquid to the sides of the spray disc sprayers.

15. A blender as claimed in claim 14 wherein the hollow drum includes means to selectively reduce the peripheral speed at the interior surface of the hollow drum at selective longitudinal places along the drum, to compensate for the increased coefficient of friction as the particles gain more resin making their surfaces increasingly tackier, thereby maintaining the uniform cascading of the particles, and the cantilevered shafts, on which the spray disc sprayers are mounted, are positioned within the upper transverse quadrant of the hollow drum in which the raising of the particles in undertaken.

16. A blender as claimed in claim 15, wherein the spray disc sprayers include additional spray disc sprayers so each cantilevered shaft has three spray disc sprayers, with two spray disc sprayers receiving one liquid and the third spray disc sprayer receiving the other liquid.

17. A blender as claimed in claim 14 wherein the spray disc sprayers are each arranged as paired disc sprayers with a space between the paired discs being wide enough so the departing sprays of droplets will not converge.

18. A blender as claimed in claim 17, wherein the spray disc sprayers are also pivotally mounted on the cantilevered shafts to direct liquid sprays in transverse planes at angles with respect to the cantilevered shafts.

19. A blender as claimed in claim 18 wherein the liquid supply assembly supplies two different liquids delivering one liquid to the spray disc sprayer on one cantilevered shaft and another liquid to the spray disc sprayer on the other cantilevered shaft.

20. A blender as claimed in claim 18 wherein the cantilevered shafts on which the spray disc sprayers are mounted are positioned within one upper transverse quadrant of the hollow drum.

21. A blender as claimed in claim 20, wherein the hollow drum includes means to selectively reduce the peripheral speed at the interior surface of the drum at selective longitudinal places along the drum, to compensate for the increasing coefficient of friction as the particles gain more resin making their surfaces increasingly tackier, thereby maintaining cascading of the particles.

22. A blender as claimed in claim 21, wherein the drive assembly rotates the hollow drum in one direction and the power assemblies rotate the spray disc sprayers in the opposite direction.

23. A blender as claimed in claims 12, 13, 14, 17, 18, 19, 20, 21 or 22, wherein the cantilevered shafts on which the spray disc sprayers are mounted are positioned within the upper transverse quadrant of the hollow drum in which the raising of the particles is undertaken, and the hollow drum is rotated at a selected angle relative to the horizontal plane and at a selected speed to create a selected number of cycles, wherein in each cycle, the particles are lifted along the interior surface of the hollow drum to an upper zenith locale within the hollow drum, where the gravitational force becomes effective to cause the particles to freely fall in an arcuate cascade down to the interior surface of the hollow drum.

24. A blender as claimed in claims 14, 15, 16, 17, 18, 19, 20, 21, 22, wherein shields are mounted adjacent the sides of the spray disc sprayers to protect the droplets from wind and dust prior to their leaving the spray disc sprayers.

25. A blender used to effectively apply finely dispersed liquid droplets of resins and/or waxes, throughout surfaces of particles, comprising:

a. a hollow drum having an inlet end and an outlet end and which is rotatably supported on a frame and downwardly inclined at a small angle to the horizontal from its higher inlet end;

b. a variable speed drive assembly to rotate the hollow drum at selectable optimum speeds to produce along its upwardly moving inner wall a thin layer of particles which leave and fall from the inner wall a small distance before reaching the uppermost peripheral point of travel to produce a free falling cascade of particles which is sufficiently dense to form an impervious curtain spaced from the downwardly moving inner wall of the hollow drum;

c. a particle receiving assembly at the inlet end of the rotatable hollow drum;

d. a particle discharging assembly at the outlet end of the hollow drum;

e. at least one cantilevered shaft extending longitudinally into the drum from an end of the drum;

f. at least one spray disc sprayer oriented angularly with respect to the drum axis and mounted on the end of the cantilevered shaft above and offset from the longitudinal axis of the drum;

g. a power assembly mounted on the end of the cantilevered shaft to operate said at least one spray disc sprayer such that spray is disposed in a full circular arc to simultaneously strike and impinge on both the thin layer and the dense cascade of particles without passing therethrough to the inner wall;

h. a liquid supply assembly connected to said at least one spray disc sprayer for delivering liquid thereto while the particles are being delivered to and removed from the rotating hollow drum;

i. said frame including an adjustable frame for rotatably supporting said hollow drum at selective angles from a horizontal axis;

j. said power assembly being secured to the cantilevered shaft which does not rotate and the power assembly directly drives said at least one spray disc sprayer;

k. said liquid supply assembly adapted for delivering the liquid to a side of said at least one spray disc sprayer;

l. said at least one spray disc sprayer including paired disc sprayers arranged with a space between the paired discs being wide enough so that departing sprays of droplets will not converge; and m. each spray disc sprayer is pivotably mounted on the cantilevered shaft for directing liquid sprays in transverse planes at angles with respect to the cantilevered shaft.

26. A blender used to effectively apply finely dispersed liquid droplets of resins and/or waxes, throughout surfaces of particles, as claimed in claim 25 wherein the hollow drum includes means to selectively reduce the peripheral speed at the interior surface of the hollow drum at selective longitudinal places along the hollow drum, to compensate for the increased coefficient of friction as the particles gain more resin making their surfaces increasingly tackier thereby maintaining the uniform cascading of the particles, and the cantilevered shaft, on which the spray disc sprayer is mounted, is positioned within the upper transverse quadrant of the drum in which the raising of the particles is undertaken.

27. A blender used to effectively apply finely dispersed liquid droplets of resins and/or waxes, throughout surfaces of particles, as claimed in claim 25, wherein:

a. the liquid supply assembly supplies two different liquids, delivering one liquid such as a resin to one spray disc of a sprayer and another liquid such as a wax to another disc of a sprayer.

28. A blender used to effectively apply finely dispersed liquid droplets of resins and/or waxes, throughout surfaces of particles, as claimed in claim 27, wherein each cantilevered shaft has three spray disc sprayers, with two spray disc sprayers receiving one liquid and the third spray disc sprayer receiving the other liquid.

29. A blender used to effectively apply finely dispersed liquid droplets of resin and/or waxes, throughout surfaces of particles, as claimed in claim 27, wherein:

a. the cantilevered shaft on which said at least one spray disc sprayer is mounted is positioned within one upper transverse quadrant of the hollow drum.

30. A blender used to effectively apply finely dispersed liquid droplets of resins and/or waxes, throughout surfaces of particles, as claimed in claim 29, wherein:

a. the hollow drum includes means to selectively reduce the peripheral speed at the interior surface of the hollow drum at selective longitudinal places along the hollow drum, to compensate for the increasing co-efficient of friction as the particles gain more resin making their surfaces increasing tackier, and thereby maintain the cascading of particles.

31. A blender used to effectively apply finely dispersed liquid droplets of resins and/or waxes, throughout surfaces of particles, as claimed in claim 30, wherein:

a. the drive assembly rotates the hollow drum in one direction and the power assembly rotates said at least one spray disc sprayer in the opposite direction.

32. A blender used to effectively apply finely dispersed liquid droplets of resins and/or waxes, throughout surfaces of particles, as claimed in claim 31, wherein:

a. the cantilevered shaft on which said at least one spray disc sprayer is mounted is positioned within the upper transverse quadrant of the hollow drum in which the raising of the particles is undertaken, and the hollow drum is rotated at a selected angle relative to the horizontal plane and at a selected speed to create a selected number of cycles, wherein in each cycle, the particles are lifted along the interior surface of the hollow drum to an upper zenith locale within the hollow drum, where the gravitational force becomes effective to cause the particles to freely fall in an arcuate cascade down to the interior surface of the hollow drum.

33. A blender used to efficiently disperse liquids, via droplets of resins and/or waxes, throughout surfaces of particles, as claimed in claims 1, 3, 4, 5 24, 27, 29, 30, 31 or 32 a shield is mounted adjacent the side of each spray disc sprayer to protect the droplets from wind and dust prior to their leaving the spray disc sprayer.

34. A blender used to effectively apply finely dispersed liquid droplets of resins and/or waxes throughout surfaces of particles, as claimed in claim 33 wherein clean air is injected between each shield and each spray disc sprayer to keep dust from entering the space between them.

35. A blender used to effectively apply finely dispersed liquid droplets of resins and/or waxes, throughout surfaces of particles, comprising:

a. a hollow drum rotatably supported on a frame for rotation about a downwardly inclined axis and having non-rotatable ends;

b. a variable speed drive assembly to rotate the hollow drum at selectable optimum speed to produce along its upwardly moving inner wall a thin layer of particles which leave and fall from the inner wall a small distance before reaching the uppermost peripherial point of travel to produce a free falling cascade of particles which is sufficiently densed to form an impervious curtain spaced from the downwardly moving inner wall of the hollow drums;

c. a particle receiving assembly at the higher end of the rotatable drums;

d. a particle discharging assembly of the other end of the drum;

e. hollow non-rotatable cantilevered shafts positioned longitudinally within the hollow drum and extending from each end thereof;

f. spray disc sprayers rotatably mounted respectively on the ends of the cantilevered shafts inside the hollow drum;

g. power assemblies mounted respectively on the ends of the cantilevered shafts to rotate the respective spray disc sprayers to create spraying gravity forces of 1,000;

h. a liquid supply assembly connected to the shaft for delivering liquid to the spray disc sprayers while the particles are being delivered and removed from the hollow non-rotatable drum;

i. said frame being adjustable and adapted to rotatably support the hollow drum at selective angles from a horizontal axis;

j. said liquid supply assembly delivers the liquid to the sides of the spray disc sprayers;

k. said spray disc sprayers being arranged as paired disc sprayers with a space between the paired discs wide enough so that the departing sprays of droplets will not converge;

l. said spray disc sprayers being pivotably mounted on the cantilevered shafts to direct liquid sprays in transverse planes at angles with respect to the cantilevered shafts;

m. said liquid supply system adapted for supplying two different liquids, delivering one liquid to the spray disc sprayer on one cantilevered shaft and another liquid to the spray disc sprayer on the other cantilevered shaft;

n. said cantilevered shafts on which the spray disc sprayers are mounted are positioned within one upper transverse quadrant of the hollow drum;

o. said hollow drum includes means to selectively reduce the peripheral speed at the interior surface of the drum at selective longitudinal places along the drum, to compensate for the increasing co-efficient of friction as the particles gain more resin making their surfaces increasingly tackier, thereby maintaining cascading of the particles;

p. said drive assembly adapted for rotating the hollow drum in one direction and the power assemblies adapted for rotating the spray disc sprayers in the opposite direction; and, q. said cantilevered shaft on which the spray disc sprayers are mounted are positioned within the upper transverse quadrant of the hollow drum in which the raising of the particles is undertaken, and the hollow drum is rotated at a selective angle relative to the horizontal plane and at selected speed to create a selected number of cycles, wherein in each cycle, the particles are lifted along the interior surface of the hollow drum to an upper zenith locale within the hollow drum, where the gravitational force becomes effective to cause the particles to freely fall in an arcuate cascade down to the interior surface of the hollow drum.

* * * * *